US008991382B1

(12) United States Patent
Mau

(10) Patent No.: US 8,991,382 B1
(45) Date of Patent: Mar. 31, 2015

(54) FIRE PIT THAT OCCUPIES A SMALL SPACE WHEN DISASSEMBLED

(76) Inventor: Paul A. Mau, Cabery, IL (US)

( * ) Notice: Subject to any disclaimer, the term of this patent is extended or adjusted under 35 U.S.C. 154(b) by 1122 days.

(21) Appl. No.: 12/984,915

(22) Filed: Jan. 5, 2011

(51) Int. Cl.
*A47J 37/07* (2006.01)
*F24B 1/181* (2006.01)
*F24C 1/16* (2006.01)

(52) U.S. Cl.
CPC ..... *F24B 1/181* (2013.01)
USPC ..... 126/9 R; 126/25 R; 126/30; 126/58; 126/59; 126/540; 248/150; 248/159; 248/165; 99/449; 99/340; 221/194; 221/132.1

(58) Field of Classification Search
CPC ..... F24B 1/022; F24B 1/202; F24B 1/205; F24B 1/181; F24B 1/02; F24B 13/02; F24C 1/16; F24C 3/002; A47J 33/00; A47J 36/2477; A47J 36/24; A47J 37/0704; A47J 37/0763; A47J 37/0694; B65D 25/24; B65D 25/20
USPC ..... 126/25 R, 58, 59, 519, 540, 29, 30, 9 R, 126/9 B, 50, 25 B; 248/150, 159, 165, 176.2; 99/340, 422, 449; 49/57; 211/194, 189, 211/181.1, 74, 132.1, 133.5, 133.6, 133.1; 220/630, 634, 636, 637, 628, 4.33
IPC .. A47J 33/00, 37/07; F24B 1/181, 13/02; F24C 1/16
See application file for complete search history.

(56) References Cited

U.S. PATENT DOCUMENTS

| | | | | | |
|---|---|---|---|---|---|
| 54,912 | A * | 5/1866 | Hyzer | 126/58 |
| 308,222 | A * | 11/1884 | Weiss | 126/58 |
| 943,569 | A * | 12/1909 | Scamardi | 126/38 |
| 1,279,033 | A * | 9/1918 | Stollberg | 110/259 |
| 1,667,913 | A * | 5/1928 | Weston | 211/133.1 |
| 3,013,550 | A * | 12/1961 | Murchie | 126/25 |
| 3,209,743 | A * | 10/1965 | Stewart et al. | 126/25 B |
| 3,331,365 | A * | 7/1967 | Sussan | 126/25 R |
| 4,094,649 | A * | 6/1978 | Osterried | 126/25 B |
| 4,414,956 | A * | 11/1983 | Webber | 126/59 |

(Continued)

FOREIGN PATENT DOCUMENTS

| | | | | |
|---|---|---|---|---|
| EP | 139853 A2 * | 5/1985 | | A47J 37/07 |
| EP | 627185 A1 * | 12/1994 | | A47J 27/13 |

(Continued)

*Primary Examiner* — Gregory Huson
*Assistant Examiner* — Daniel E Namay
(74) *Attorney, Agent, or Firm* — Ronald E. Smith; Smith & Hopen, P.A.

(57) ABSTRACT

A fire pit includes a circular bottom plate and a circular, centrally-apertured log-supporting plate. A plurality of legs secured about the periphery of the log-supporting plate maintain the bottom and log-supporting plates in vertically spaced, parallel relation to one another. Each leg has a hollow uppermost end. A plurality of arcuate grates is mounted about the periphery of the log-supporting plate and a vertically-oriented post is secured to each of the grates, mid-length thereof. Each of the posts has a lowermost end slideably received within the hollow uppermost end of its associated leg to releasably connect each grate to the log-supporting plate. Arcuate openings positioned radially outwardly of the central opening enhance the flow of oxygen into the areas where combustion occurs. The log-supporting plate is inverted and the grates are stacked atop it when the fire pit is in its storage configuration.

9 Claims, 6 Drawing Sheets

(56) References Cited

U.S. PATENT DOCUMENTS

| | | | | | |
|---|---|---|---|---|---|
| 4,502,460 | A * | 3/1985 | Kelz | 126/29 |
| 4,651,708 | A * | 3/1987 | Groeneweg | 126/30 |
| 4,699,120 | A * | 10/1987 | Ogden | 126/25 A |
| 4,915,091 | A * | 4/1990 | Varney | 126/65 |
| 5,222,475 | A * | 6/1993 | Greener | 126/41 R |
| 5,596,980 | A * | 1/1997 | Whalen et al. | 126/519 |
| 5,598,834 | A * | 2/1997 | Grady | 126/506 |
| D382,765 | S * | 8/1997 | Kellermann | D7/332 |
| 5,682,872 | A * | 11/1997 | Whitted | 126/29 |
| 5,836,298 | A * | 11/1998 | Grady | 126/506 |
| 5,941,400 | A * | 8/1999 | Lemaire | 211/201 |
| 5,960,788 | A * | 10/1999 | Bach et al. | 126/506 |
| 6,029,566 | A * | 2/2000 | McLemore | 99/400 |
| 6,227,398 | B1 * | 5/2001 | Yang et al. | 220/9.4 |
| 6,419,103 | B1 * | 7/2002 | Wang | 220/4.33 |
| 6,802,312 | B1 * | 10/2004 | Kuelbs | 126/519 |
| 6,851,423 | B2 * | 2/2005 | Klemming | 126/506 |
| 7,383,836 | B2 * | 6/2008 | Klemming | 126/506 |
| 8,613,277 | B2 * | 12/2013 | Hall et al. | 126/92 B |
| 2002/0185122 | A1 * | 12/2002 | Bossler | 126/519 |
| 2003/0075166 | A1 | 4/2003 | Glass | |
| 2003/0106548 | A1 * | 6/2003 | Tseng | 126/506 |
| 2004/0079357 | A1 * | 4/2004 | Klemming | 126/519 |
| 2004/0123857 | A1 * | 7/2004 | Viraldo | 126/9 R |
| 2004/0211410 | A1 * | 10/2004 | Kuelbs | 126/519 |
| 2004/0255930 | A1 * | 12/2004 | Klemming | 126/506 |
| 2005/0039612 | A1 * | 2/2005 | Denny | 99/450 |
| 2005/0229916 | A1 * | 10/2005 | Fitzgerald | 126/25 R |
| 2006/0037605 | A1 * | 2/2006 | Fitzgerald et al. | 126/519 |
| 2009/0107483 | A1 * | 4/2009 | Fitzgerald et al. | 126/519 |
| 2010/0116262 | A1 * | 5/2010 | Voges | 126/25 R |
| 2010/0236544 | A1 * | 9/2010 | Hall et al. | 126/85 R |
| 2010/0288263 | A1 * | 11/2010 | Sykes et al. | 126/519 |
| 2011/0073098 | A1 * | 3/2011 | Chang | 126/25 B |
| 2012/0073561 | A1 * | 3/2012 | Gregory | 126/25 R |
| 2012/0255538 | A1 * | 10/2012 | Merritt | 126/25 R |
| 2012/0318255 | A1 * | 12/2012 | Brown | 126/25 R |

FOREIGN PATENT DOCUMENTS

| | | | | |
|---|---|---|---|---|
| GB | 2442702 | A * | 4/2008 | A47J 37/07 |
| JP | 07000295 | A * | 1/1995 | A47J 37/07 |
| WO | WO 9736526 | A1 * | 10/1997 | A47J 37/07 |
| WO | WO 03042598 | A1 * | 5/2003 | F24B 1/18 |

* cited by examiner

FIRE PIT THAT OCCUPIES A SMALL SPACE WHEN DISASSEMBLED

BACKGROUND OF THE INVENTION

1. Field of the Invention

This invention relates, generally, to fire pits. A fire pit provides a safe way to burn logs or other combustible materials.

2. Description of the Prior Art

A campfire built on the ground has several disadvantages. For example, the ground may be wet, making fire-starting difficult. Stacking the logs can also be a haphazard activity that does not result in well-ordered logs. Accordingly, oxygen may not flow into the fire in an optimal manner. Moreover, a campfire may also be desired at a campground that lacks camp fire areas.

A fire pit is formed of a suitable metal or a metal alloy and has the advantage of spacing the logs or other combustible materials away from the ground. Fire pits can also be used in campgrounds that lack dedicated campfire areas.

The known fire pits lack means for arranging logs in a non-haphazard manner. Perhaps more importantly, conventional fire pits are also of large, bulky construction and cannot be easily taken apart or assembled. Moreover, they occupy a considerable amount of storage space when assembled and not much less when disassembled.

There is a need for a fire pit construction that is easy to assemble and disassemble. There is a need as well for a fire pit that occupies a small space when disassembled.

However, in view of the art considered as a whole at the time the present invention was made, it was not obvious to those of ordinary skill in the art how the needed improvements could be provided.

SUMMARY OF THE INVENTION

The long-standing but heretofore unfulfilled need for an improved fire pit is now met by a new, useful, and non-obvious invention.

The novel fire pit includes a circular bottom plate, and a circular log-supporting plate having a diameter substantially the same as the diameter of the circular bottom plate. The circular log-supporting plate is positioned in substantial axial alignment with the circular bottom plate in vertically spaced, parallel relation thereto.

The circular bottom plate has an upstanding flange formed about its periphery to hold ashes atop the circular bottom plate and to prevent or reduce the spread of ashes onto the ground adjacent the fire pit.

A plurality of leg members is secured about the periphery of the log-supporting plate and depends therefrom. A plurality of bosses is mounted about the periphery of the circular bottom plate in equidistantly and circumferentially spaced apart relation to one another, just radially inwardly of the upstanding flange. Each of the bosses is adapted to slideably receive a lowermost end of an associated leg member that depends from the circular log-supporting plate. Each leg member of the plurality of leg members has a common length so that the leg members determine the amount of vertical spacing between the circular bottom plate and the circular log-supporting plate.

Each leg member of the plurality of leg members has a hollow uppermost end that extends slightly above a plane of the circular log-supporting plate.

A plurality of arcuate grates is mounted about the periphery of the circular log-supporting plate. The lowermost end of each arcuate grate is positioned substantially co-planar with the plane of the circular log-supporting plate. A vertically-oriented post is secured to each of the grates, mid-length thereof. Each of said vertically-oriented posts has a lowermost end slideably received within the hollow open end of its associated leg member to releasably connect each grate to the periphery of the circular log-supporting plate. Each grate is generally rectangular in front elevation and arcuate in plan view.

A central opening is formed in the circular log-supporting plate in the center thereof. A plurality of arcuate openings is positioned radially outwardly of the central opening in equidistantly and circumferentially spaced apart relation to one another, just radially inwardly of a peripheral edge of the circular log-supporting plate. Each of the arcuate openings is provided to enhance airflow into the combustion area. The arcuate openings may also be used to receive a preselected end of a log so that after a lowermost end of each log is placed in an associated opening, the respective uppermost ends of the logs are tilted toward each other so that they meet at a central location, forming a pyramid. The pyramidal shape enhances oxygen flow into the areas where combustion occurs and also provides a framework that maintains additional logs or other combustible materials in a generally pyramidal shape as such additional combustible materials are added to the fire.

A cylindrical shroud has a diameter substantially equal to the diameter of the central opening. The cylindrical shroud is disposed in axial alignment with the central opening, depends therefrom, and has a preselected length so that the cylindrical shroud does not extend to the circular bottom plate. A strip of metal is disposed in spanning relation to the cylindrical shroud at its lowermost end to support a newspaper or other item that can help start a log fire.

A pair of handles is formed integrally with the circular bottom plate in diametrically opposed relation to one another to facilitate manual transportation of the fire pit in its assembled or disassembled configuration.

A plurality of legs is mounted about the periphery of the circular bottom plate to hold the circular bottom plate in spaced relation above a support surface. The circular bottom plate must be elevated about three inches (3") above the ground or other support surface.

The novel structure is easily assembled and disassembled. It occupies a small space when disassembled.

An important object of the invention is to provide a fire pit that is easily assembled and disassembled and that occupies a small space when disassembled for storage.

Another important object is to provide a fire pit that facilitates the free flow of air into the combustion zone to improve the efficiency of combustion.

These and other important objects, advantages, and features of the invention will become clear as this description proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

Figure 1:
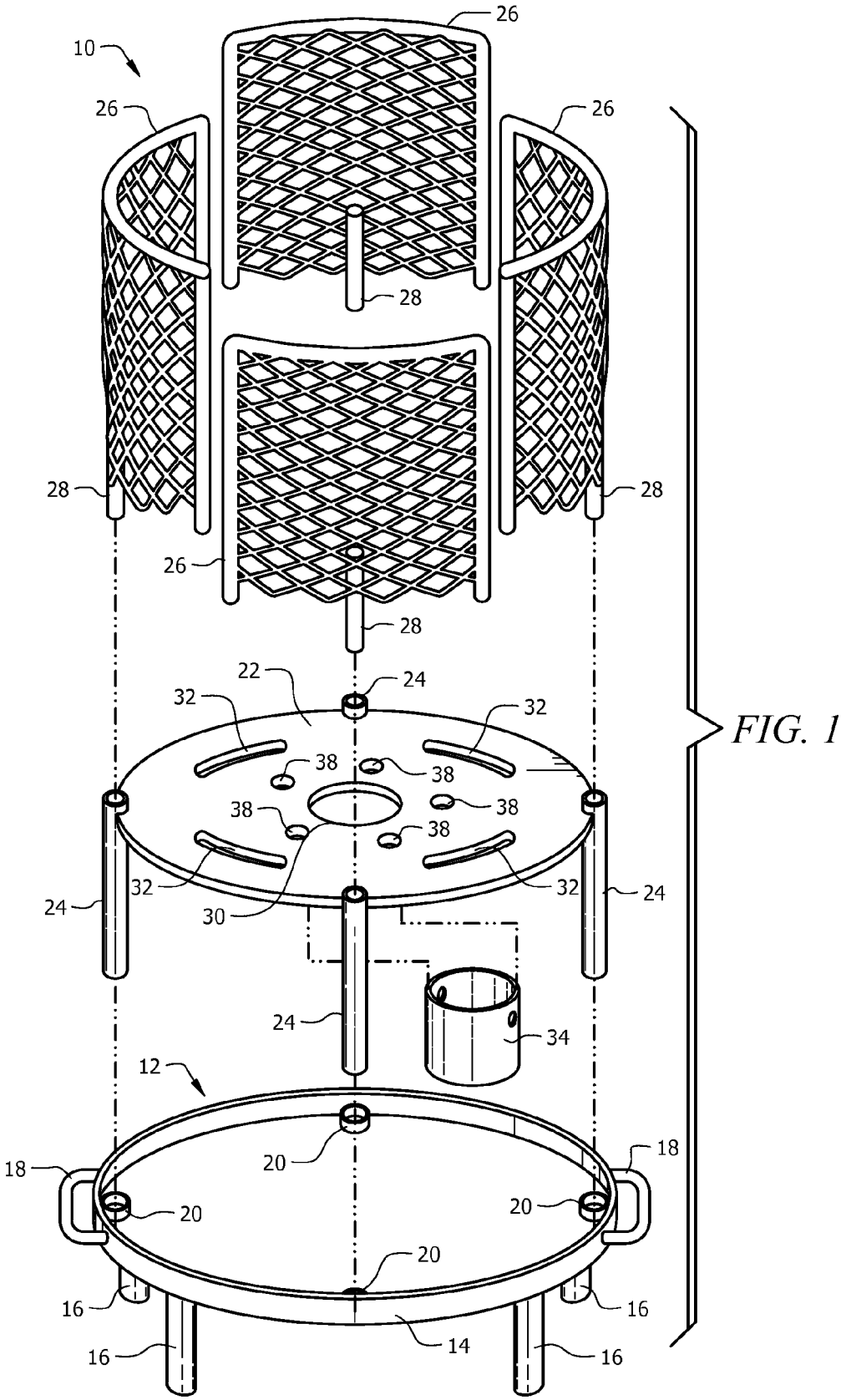
FIG. 1 is an exploded perspective view of a first embodiment.

FIG. 1 depicts an illustrative embodiment of the novel fire pit which is denoted as a whole by the reference numeral 10.

Fire pit 10 includes circular bottom plate 12 having upstanding flange 14 formed about its periphery. Upstanding flange 14 serves to hold ashes atop circular bottom plate 12 to prevent or reduce the spread of ashes onto the ground adjacent the fire pit.

A plurality of legs, collectively denoted 16, is mounted about the periphery of circular bottom plate 12 and hold said circular bottom plate in spaced relation above the ground. The preferred spacing is about three inches (3").

Handles 18, 18 are formed integrally with circular bottom plate 12 in diametrically opposed relation to one another and facilitate manual transportation of fire pit 10 in its assembled or disassembled configuration.

In a preferred embodiment, four bosses, collectively denoted 20, are mounted about the periphery of circular bottom plate 12 in equidistantly and circumferentially spaced apart relation to one another, just radially inwardly of upstanding flange 14. However, four bosses are not required; in a simplified embodiment, only two (2) bosses are used and they work just as well as four (4) bosses.

Circular log-supporting plate 22 has a diameter that, in this first embodiment, is substantially the same as the diameter of circular bottom plate 12 and is positioned in substantial axial alignment with circular bottom plate 12 in vertically spaced, parallel relation thereto. The amount of vertical spacing is determined by the length of legs, collectively denoted 24, that are secured about the periphery of log-supporting plate 22.

Figure 3A:
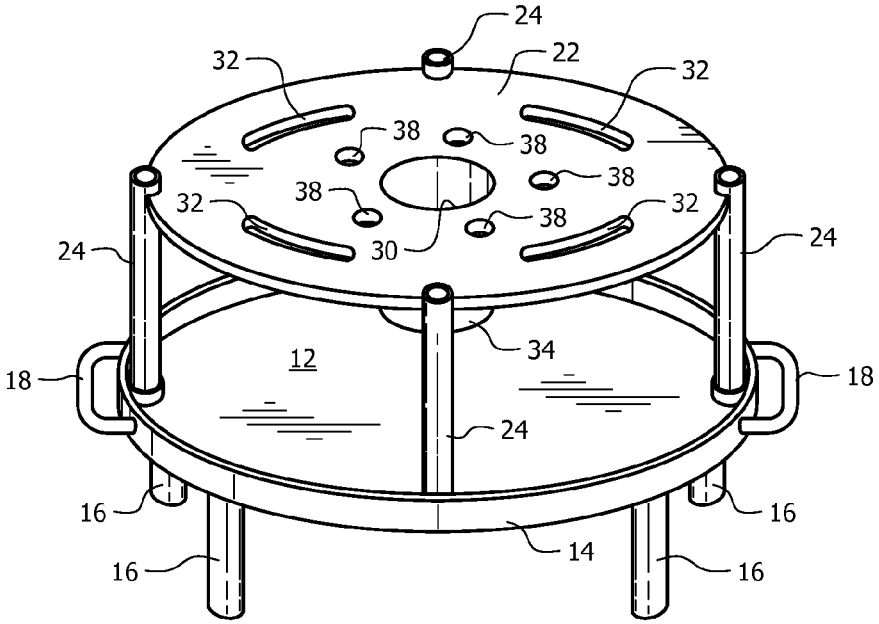
FIG. 3A is a perspective view of the assembled log-supporting plate and bottom plate.
Figure 3B:
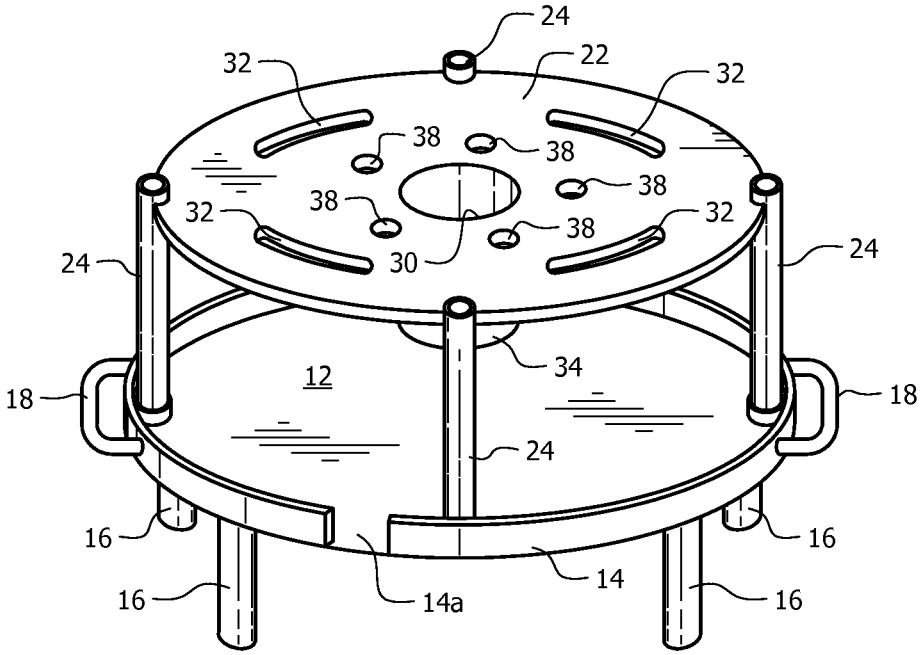
FIG. 3B depicts a modified version of the bottom plate.

The lowermost end of each leg 24 is slideably received within a boss 20 when fire pit 10 is in its assembled configuration. The uppermost end of each leg 24 is hollow and extends slightly above the plane of circular log-supporting plate 22 as best depicted in FIGS. 1, 3A and 3B.

A plurality of arcuate grates, collectively denoted 26, is mounted about the periphery of circular log-supporting plate 22. Each grate 26 is generally rectangular but is arcuate when viewed in plan. More particularly, each grate has a predetermined curvature so that a circle having a diameter substantially equal to a diameter of said circular log-supporting plate is collectively formed by the plurality of grates when fire-pit 10 is fully assembled.

A vertically-oriented post 28 is secured to each grate 26, mid-length thereof, i.e., at the bight of the arc.

Figure 2:
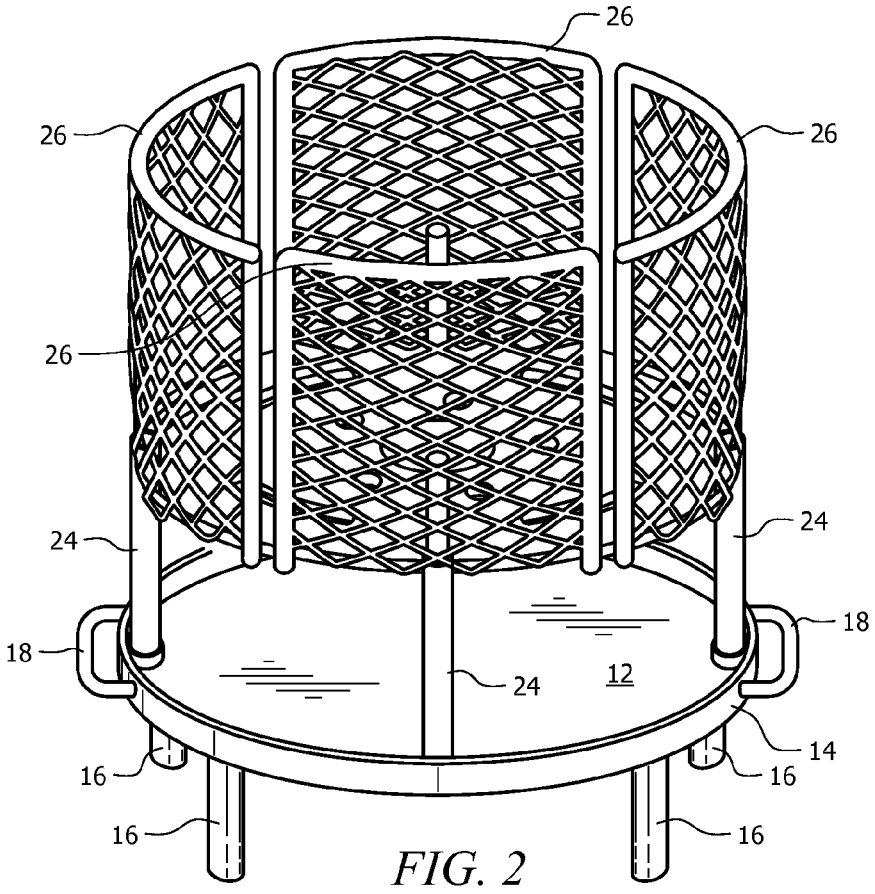
FIG. 2 is a perspective view of the first embodiment in its assembled configuration.

The lowermost end of each post 28 is slideably received with the hollow open end of its associated leg 24 to thereby releasably connect each grate 26 to the periphery of circular log-supporting plate 22 as indicated in FIG. 1 by assembly lines and as depicted in FIG. 2.

Central opening 30 is formed in log-supporting plate 22 in the center thereof. A plurality of arcuate openings, collectively denoted 32, is positioned radially outwardly of central opening 30, in equidistantly and circumferentially spaced apart relation to one another, just radially inwardly of the peripheral edge of circular log-supporting plate 22.

Figure 6:
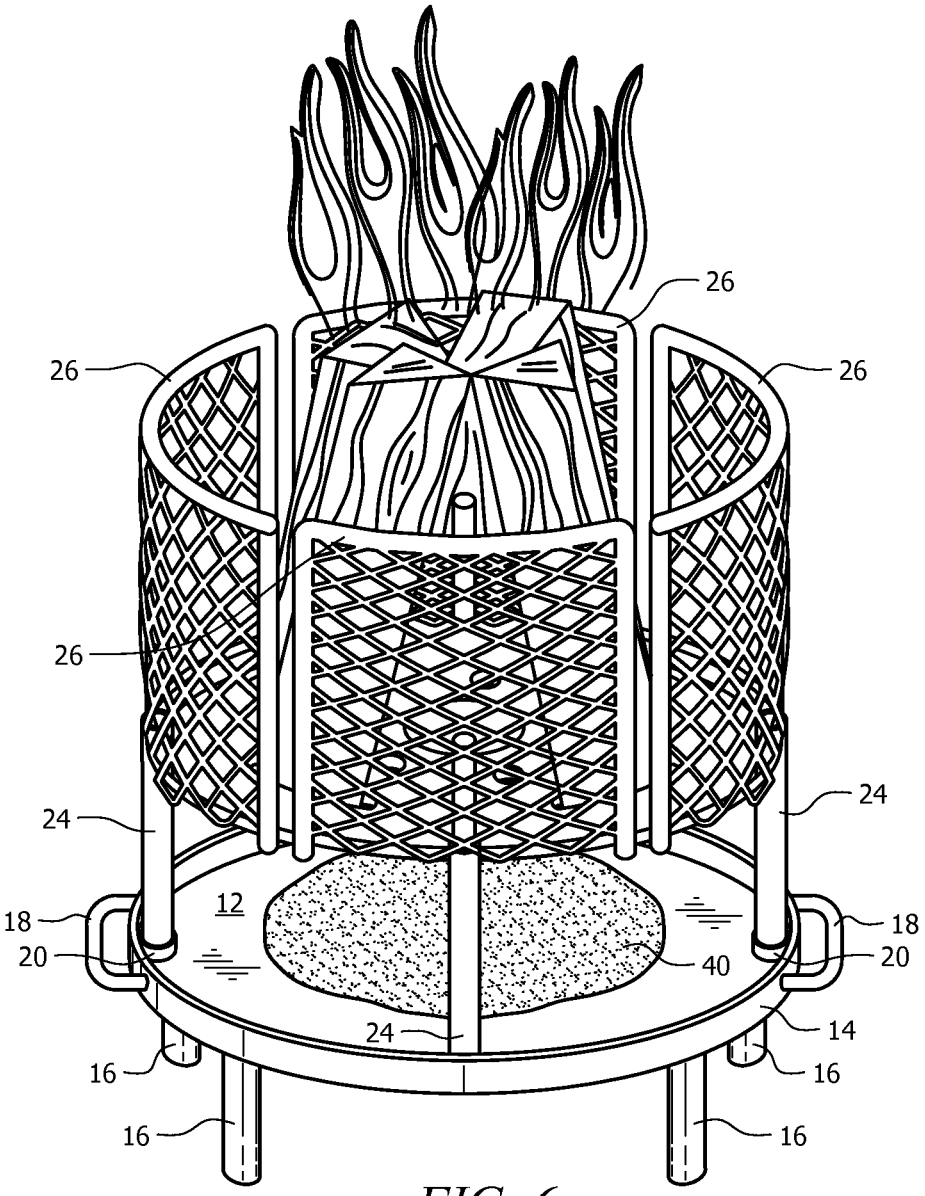
FIG. 6 is a perspective view depicting the fully assembled first embodiment when in use.

As best understood by comparing FIGS. 1, 3A, 3B and 6, each arcuate opening 32 is adapted to receive a preselected end of a log. After the lowermost end of each log has been placed in its associated arcuate opening 32, the respective uppermost ends of the logs are tilted toward each other so that meet at a central location, forming a four-sided pyramid as depicted in FIG. 6. Such shape enhances oxygen flow into the areas where combustion occurs. At least three arcuate openings 32 are required to facilitate a log pyramid to enhance oxygen flow, but the depicted number of arcuate openings 32 is not critical and five or more of such arcuate openings are also within the scope of this invention.

However, it is not critical to use arcuate openings 32 in the manner just disclosed. Said arcuate opening may be ignored when logs and other combustible items are arranged atop log-supporting plate 22. Said arcuate openings are provided primarily to enhance oxygen flow into the combustion zone and not to serve as log positioners.

Figure 4:
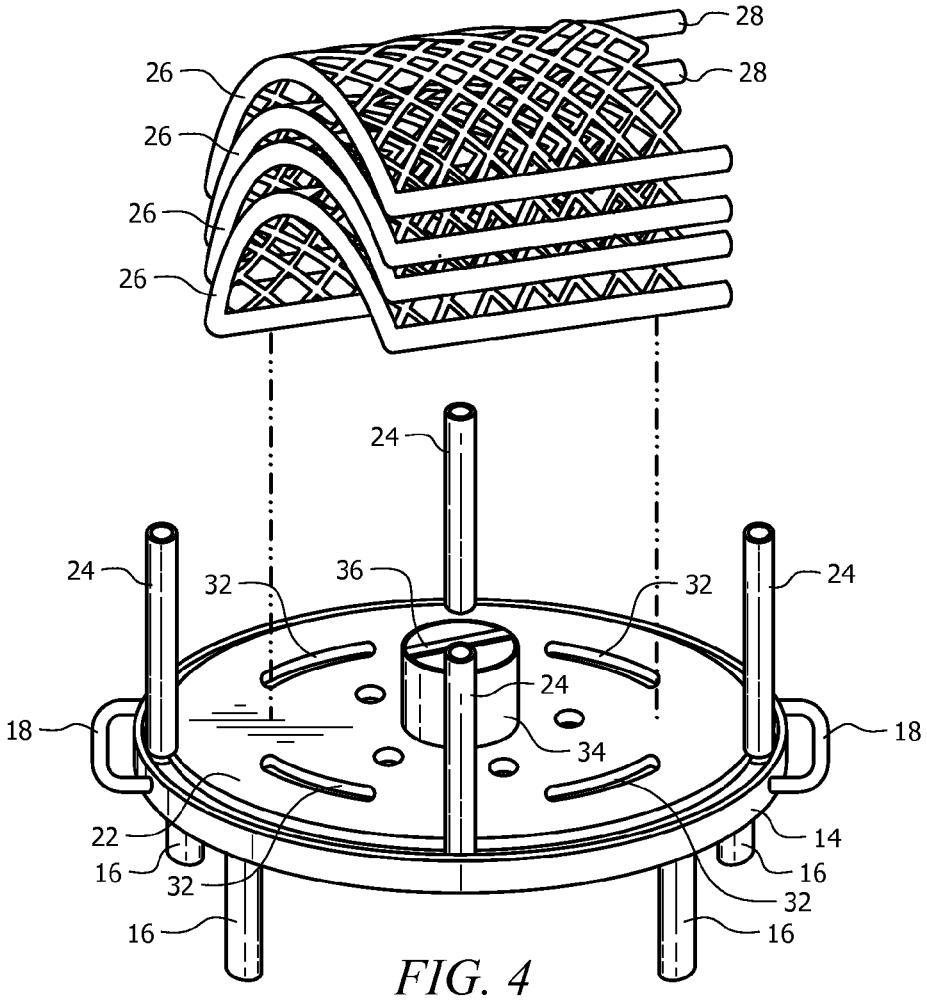
FIG. 4 is a perspective view indicating how the novel structure is disassembled preparatory to storage.

Cylindrical shroud 34 has a diameter substantially equal to the diameter of central opening 30 formed in log-supporting plate 22 and depends therefrom in axial alignment therewith. The length of cylindrical shroud is preselected so that it does not extend to circular bottom plate 12. As depicted in FIG. 4, a flat strip of metal 36 extends across the bottom edge of cylindrical shroud 34 to support a newspaper or other item that burns easily to start a fire. The novel fire pit will not smoke as long as shroud 34 and central opening 30 is not plugged up.

Openings 38 are formed in circular log-supporting plate 22 in equidistantly and circumferentially spaced relation to one another and in radially outward relation to central opening 30. Openings 38, like central opening 30 and arcuate openings 32, facilitate airflow into the combustion area.

Figure 7:
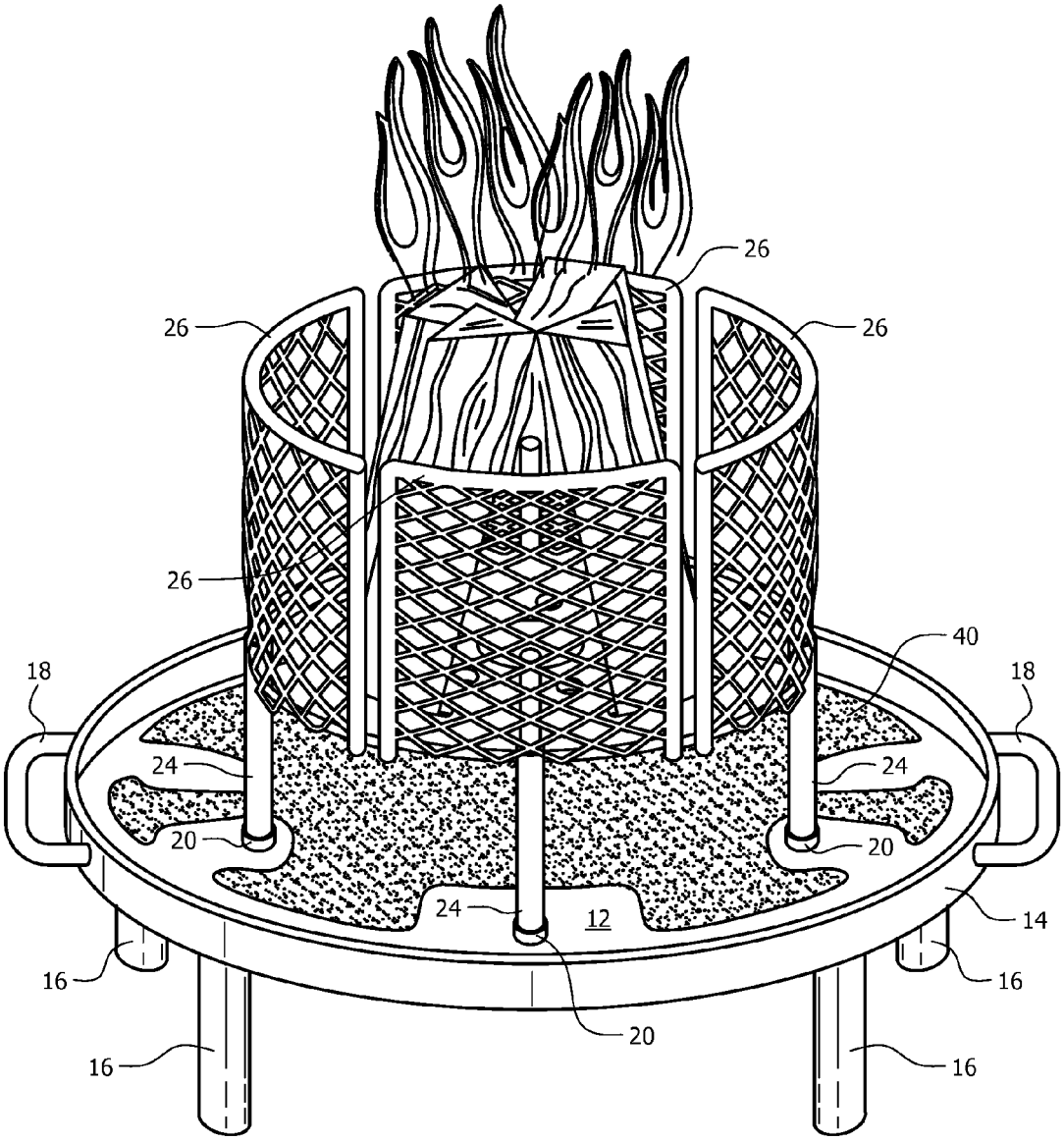
FIG. 7 depicts a fully assembled second embodiment when in use.

FIG. 7 depicts a second embodiment where the diameter of circular bottom plate 12 exceeds the diameter of circular log-supporting plate 22. This increases the ash-collecting capacity of circular bottom plate 12. Where the diameter of circular log-supporting plate is fifteen and a half inches (15.5"), the diameter of circular bottom plate may be about eighteen inches (18") as depicted in FIG. 7, or it may be about twenty four inches (24"). The dimensions are not critical to the invention.

Figure 5:
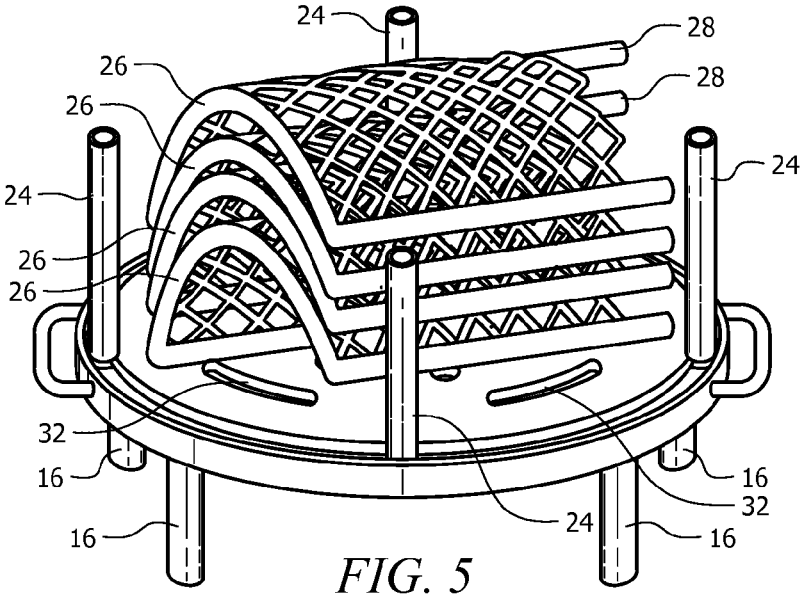
FIG. 5 is a perspective view depicting the grates when stored atop the circular log-supporting plate.

To disassemble novel fire pit 10, each arcuate grate 26 is lifted to disengage its post 28 from the hollow end of its associated leg 24. Circular log-supporting plate 22 is then lifted to disengage legs 24 from bosses 20. Circular log-supporting plate 22 is then inverted as depicted in FIGS. 4 and 5 so that legs 24 extend upwardly and the inverted circular log-supporting plate 22 is then placed atop circular bottom plate 12. A first grate 26 is then placed atop circular bottom plate 12, a second grate is placed atop the first grate, a third grate is placed atop the second grate and the fourth grate is placed atop the third grate. The fully stored configuration is depicted in FIG. 5.

FIG. 6 depicts the first embodiment when fully assembled and in use. Reference numeral 40 indicates ashes that have fallen through circular opening 30 and cylindrical shroud 34. FIG. 6 depicts four logs in pyramidal array but it should be understood that the invention is not limited to that number of logs and it also facilitates the burning of other combustible items as well.

A modified, optional version of the novel structure is depicted in FIG. 3B. Opening 14*a* is formed in flange 14 at any preselected location. The extent of opening 14*a* is not critical but it should probably be about an inch in extent or maybe a few inches. Opening 14*a* allows a user to tilt circular bottom plate 12 so that ashes may slide through opening 14*a*, thereby clearing ashes from said circular bottom plate 12.

People who have used the novel fire pit report that their clothes do not smell of smoke thereafter. This phenomenon is probably a result of the excellent combustion that results from the physical structure disclosed above.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A fire pit, comprising:

a circular bottom plate;

a circular log-supporting plate having a diameter substantially the same as a diameter of said circular bottom plate;

said circular log-supporting plate positioned above said circular bottom plate in substantial axial alignment with said circular bottom plate in vertically spaced, parallel relation thereto;

a plurality of leg members secured about the periphery of said log-supporting plate and depending therefrom;

each leg member of said plurality of leg members having a common length and each leg member having a lowermost end that overlies and abuts said circular bottom plate so that the common length of said leg members determines the amount of vertical spacing between said circular bottom plate and said circular log-supporting plate;

each leg member of said plurality of leg members having a hollow uppermost end that extends slightly above a plane of said circular log-supporting plate;

a plurality of independently formed, arcuate grates mounted about the periphery of said circular log-supporting plate, each of said arcuate grates having a common predetermined curvature so that a circle having a diameter substantially equal to a diameter of said circular log-supporting plate is collectively formed by said plurality of arcuate grates;

a vertically-oriented post secured to each of said arcuate grates, mid-width thereof;

each of said vertically-oriented posts having a lowermost end slideably received within the hollow open end of its associated leg member to thereby releasably and independently connect each arcuate grate to the periphery of said circular log-supporting plate;

said fire pit being disassembled for storage by lifting said arcuate grates so that their respective vertically-oriented posts are separated from their associated hollow open ends, lifting said circular log-supporting plate to separate the leg members of said circular log-supporting plate from said circular bottom plate, inverting said circular log-supporting plate and positioning it in overlying relation to said circular bottom plate so that the leg members of said circular log-supporting plate are disposed in upstanding relation to said circular log-supporting plate, and positioning said arcuate grates in nested, stacked relation to one another in overlying relation to said circular log-supporting plate so that said nested, stacked arcuate grates are surrounded by said upstanding leg members of said circular log-supporting plate.

2. The fire pit of claim 1, further comprising:

said circular bottom plate having an upstanding flange formed about its periphery to hold ashes atop said circular bottom plate and to prevent or reduce the spread of ashes onto the ground adjacent the fire pit.

3. The fire pit of claim 2, further comprising:

a plurality of bosses mounted about the periphery of said circular bottom plate in equidistantly and circumferentially spaced apart relation to one another, just radially inwardly of said upstanding flange, at least two of said bosses adapted to slideably receive a lowermost end of an associated leg member.

4. The fire pit of claim 2, further comprising:

an opening of predetermined extent formed in said flange to facilitate removal of ashes from said circular bottom plate.

5. The fire pit of claim 1, further comprising:

a central opening formed in said circular log-supporting plate.

6. The fire pit of claim 5, further comprising:

a plurality of arcuate openings positioned radially outwardly of said central opening in equidistantly and circumferentially spaced apart relation to one another, just radially inwardly of a peripheral edge of said circular log-supporting plate;

whereby said plurality of arcuate openings enhances oxygen flow into the areas where combustion occurs.

7. The fire pit of claim 5, further comprising:

a cylindrical shroud having a diameter substantially equal to the diameter of said central opening;

said cylindrical shroud disposed in axial alignment with said central opening and depending therefrom;

said cylindrical shroud having a preselected vertical extent so that said cylindrical shroud does not extend to said circular bottom plate; and a strip of metal disposed in spanning relation to said cylindrical shroud at its lowermost end to provide support for a fire-starting material.

8. The fire pit of claim 1, further comprising:

a plurality of legs mounted about the periphery of said circular bottom plate to hold said circular bottom plate in spaced relation above a ground surface.

9. The fire pit of claim 1, further comprising:

a pair of handles formed integrally with said circular bottom plate in diametrically opposed relation to one another to facilitate manual transportation of the fire pit in its assembled or disassembled configuration.

* * * * *